US010035235B2

(12) United States Patent
Giurlani et al.

(10) Patent No.: US 10,035,235 B2
(45) Date of Patent: Jul. 31, 2018

(54) DEVICE FOR SHARPENING BLADES

(71) Applicant: FUTURA S.P.A., Capannori (LU) Fraz. Guamo (IT)

(72) Inventors: Giovacchino Giurlani, Capannori (IT); Ciro Guarini, Pisa (IT)

(73) Assignee: FUTURA S.P.A., Guamo (IT)

( * ) Notice: Subject to any disclaimer, the term of this patent is extended or adjusted under 35 U.S.C. 154(b) by 116 days.

(21) Appl. No.: 15/038,842

(22) PCT Filed: Oct. 17, 2014

(86) PCT No.: PCT/IT2014/000273
§ 371 (c)(1),
(2) Date: May 24, 2016

(87) PCT Pub. No.: WO2015/083188
PCT Pub. Date: Jun. 11, 2015

(65) Prior Publication Data

US 2017/0036316 A1 Feb. 9, 2017

(30) Foreign Application Priority Data

Dec. 2, 2013 (IT) ..... FI2013A0294

(51) Int. Cl.
*B24B 3/46* (2006.01)
*B24D 15/08* (2006.01)
*B24B 3/36* (2006.01)

(52) U.S. Cl.
CPC ..... *B24B 3/46* (2013.01); *B24B 3/36* (2013.01); *B24D 15/082* (2013.01)

(58) Field of Classification Search
CPC ..... B24B 3/36; B24B 3/361; B24B 3/368; B24B 3/46; B24B 3/463; B24B 3/466; B24B 3/54; B24B 27/0076; B24D 15/06; B24D 15/081; B24D 15/082; B26D 7/12
See application file for complete search history.

(56) References Cited

U.S. PATENT DOCUMENTS 1,039,210 A * 9/1912 Stukart ..... B24B 3/463 451/422
1,129,736 A * 2/1915 Sayer ..... B24B 3/463 451/422
1,165,342 A * 12/1915 Peterson ..... B24B 3/463 451/422

(Continued)

*Primary Examiner* — Timothy V Eley
(74) *Attorney, Agent, or Firm* — McGlew and Tuttle, P.C.

(57) ABSTRACT

Sharpening device for sharpening blades mounted on cutting machines, comprising two grinding wheels (2, 3) supported by respective movable supports (20, 30) adapted to move said grinding wheels (2, 3) from a standby or rest configuration in which the grinding wheels (2, 3) are positioned at a predetermined distance from the blade (4) to an active configuration in which the grinding wheels (2, 3) are in contact with a cutting edge (40) of the blade (4) and vice-versa along a predetermined trajectory (R2, R3). The movable supports (20, 30) are adapted to move said grinding wheels (2, 3) along respective arcuate trajectories, such that the contact of each grinding wheel (2, 3) with a respective side of the cutting edge (40) of the blade (4) is progressive, whereby the contact between the grinding wheels and the blade increases progressively when the device passes from the standby rest configuration to the active configuration.

12 Claims, 4 Drawing Sheets

(56) References Cited

U.S. PATENT DOCUMENTS

| | | | | | |
|---|---|---|---|---|---|
| 1,263,450 | A * | 4/1918 | Maimin | B24B 3/463 | 30/139 |
| 1,907,585 | A * | 5/1933 | Roetering | B24B 3/463 | 451/422 |
| 2,597,325 | A * | 5/1952 | Hodges | B24B 3/466 | 451/258 |
| 2,632,289 | A * | 3/1953 | Ditting | B24B 3/46 | 451/422 |
| 3,010,261 | A * | 11/1961 | Rudszinat | B24B 3/46 | 451/422 |
| 4,173,846 | A * | 11/1979 | Steiner | B23D 63/14 | 451/422 |
| 4,262,452 | A * | 4/1981 | Lopez | B24B 23/00 | 451/210 |
| 5,038,647 | A * | 8/1991 | Biagiotti | B26D 1/54 | 83/155.1 |
| 5,906,534 | A * | 5/1999 | Folkman | B24B 3/54 | 451/45 |
| 9,227,288 | B2 * | 1/2016 | Arndt | B24B 3/36 | |
| 9,393,662 | B2 * | 7/2016 | Schroeder | B24B 3/40 | |
| 2006/0011015 | A1 * | 1/2006 | Chiocchetti | B24B 3/368 | 76/81.7 |
| 2009/0275272 | A1 | 11/2009 | Bonapace | | |
| 2012/0184186 | A1 | 7/2012 | Graham, Jr. et al. | | |
| 2013/0295824 | A1 | 11/2013 | Hasegawa | | |

* cited by examiner

DEVICE FOR SHARPENING BLADES

The present invention relates to a device for sharpening blades that can be used, in particular, for the production of paper rolls.

It is known that, in a conventional process for the production of paper rolls, a rewinder is used for winding a paper web around a cardboard core to obtain an intermediated product, commonly called "log", that is made by a paper roll wound around the core and is destined to be transversely cut to obtain rolls having a commercial size, i.e. shorter paper rolls.

The transverse cut of the logs is made by means of cutting machines provided with circular blades or band saws.

The transverse cut of the logs is particularly critical. In fact, the cutting of the logs along planes that are not perfectly orthogonal to the axis of the same involves the formation of defective rolls, in which the side bases are oblique. This drawback is even more serious when the rolls are intended to be used in automatic dispensers which require, in fact, rolls with the side bases perfectly orthogonal to the axis of the rolls themselves, otherwise the rolls tend to get jammed in the dispenser.

Therefore, it is necessary provide a sharpening of the blades at regular intervals but this operation may result in a considerable reduction in the production especially considering that the cutting machines for the production of paper rolls normally work at a very high speed, so that even short stops involve remarkable production losses.

The main object of the present invention is to allow an effective sharpening of blades with a device that can equip permanently the cutting machine. This result is achieved, according to the present invention, by adopting the idea of realizing a device having the features indicated in claim 1 Other features of the invention are the subject of the dependent claims.

Among the advantages offered by the present invention, there is that it is possible to sharpen a blade effectively and quickly; that the sharpening can be performed by acting in real time, without interrupting the operation of the cutting machine; that the device can be activated in an automatic way, by connecting it to a respective control apparatus; that the present device can equip existing machines, and can be installed with relatively simple operations; that the present device does not require prolonged maintenance interventions, basically keeping its characteristics unchanged even if used for a long time.

These and other advantages and features of the present invention will be best understood by anyone skilled in the art from the following description and with the help of the accompanying figures, given as a practical exemplification of the invention, but not to be considered in a limitative sense, in which:

FIGS. 1A, 1B schematically show a device in accordance with the present invention associated with a blade in a waiting configuration, represented, respectively, in a side view (FIG. 1A) and a front view (FIG. 1B), with parts removed and/or sectioned to better illustrate other parts;

FIGS. 2A, 2B schematically show the present device in an active configuration, represented, respectively, in a side view (FIG. 2A) and a front view (FIG. 2B), with parts removed and/or sectioned to better illustrate others;

Figure 1B:
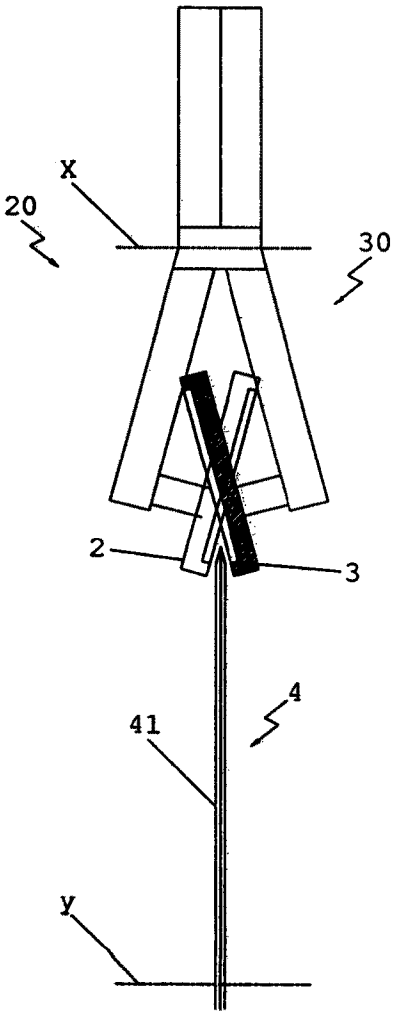

With reference to the attached drawings (in particular, FIGS. 1A to 28), a device (1) in accordance with the present invention can be used for sharpening blades, in particular for a cutting machine provided with a blade (4). The blade (4) is provided with two inclined parts (bevels) that, joining with each other, form the sharp edge or cutting edge (40).

The device (1) comprises two grinding wheels (2, 3) supported by corresponding movable arms (20, 30) which, on command, move said grinding wheels (2, 3) in contact with said sharp edge (40) to perform a sharpening operation.

Said arms (20, 30) are fulcrated to each other so as to define a first-class double lever like scissors, with resistant force consisting in the friction generated by the contact of the grinding wheels (2, 3) with the blade (4). The fulcrum of the double lever formed by the arms (20, 30) has an axis (x) perpendicular to the cutting plane (P) defined by the sharp edge (40) of the blade (4). Said axis (x) is external to the blade and is parallel to a rotation axis (y) of the latter. The distal portions (L20, L30) of the arms (20, 30) have a length whose value is such that the grinding wheels (2, 3) can be moved along corresponding trajectories interfering with the sharp edge (40) of the blade (4) so as to allow sharpening as further described in the following.

The block (M) in the drawings represents motor means acting on the proximal portions (200, 300) of said arms (20, 30) so as to constitute the force applied to the double lever formed by the same arms. The motor means (M) act bidirectionally so as to move the proximal portions (200, 300) of the arms (20, 30) towards or away from each other, thereby moving the distal portions of the arms that support the wheels (2, 3).

Figure 1A:
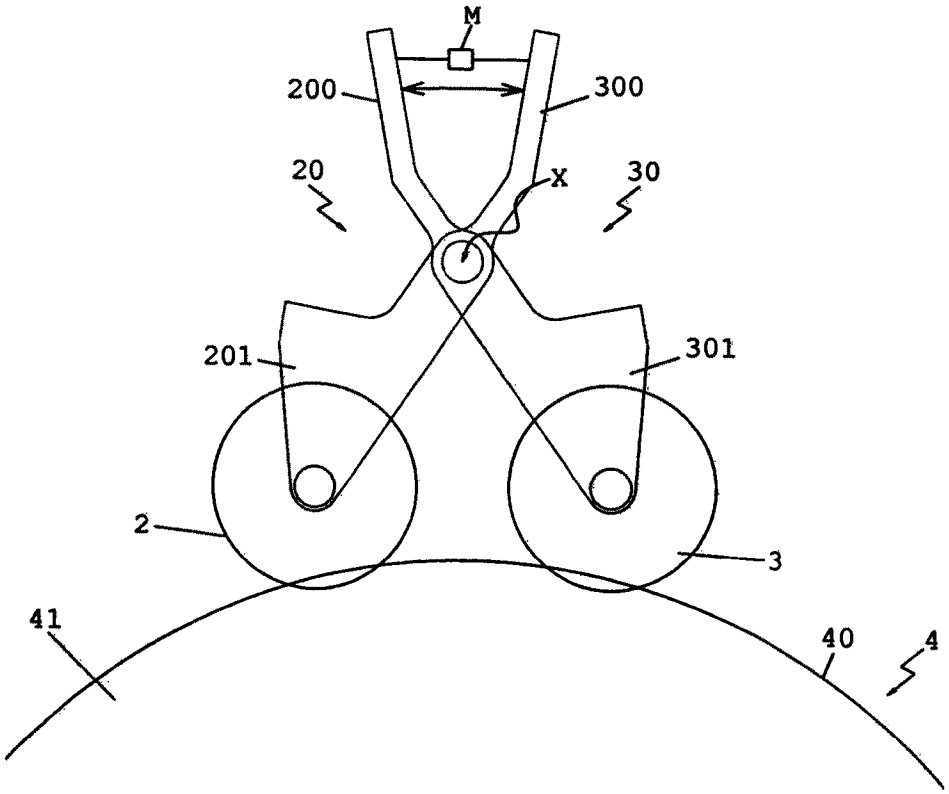
Figure 2B:
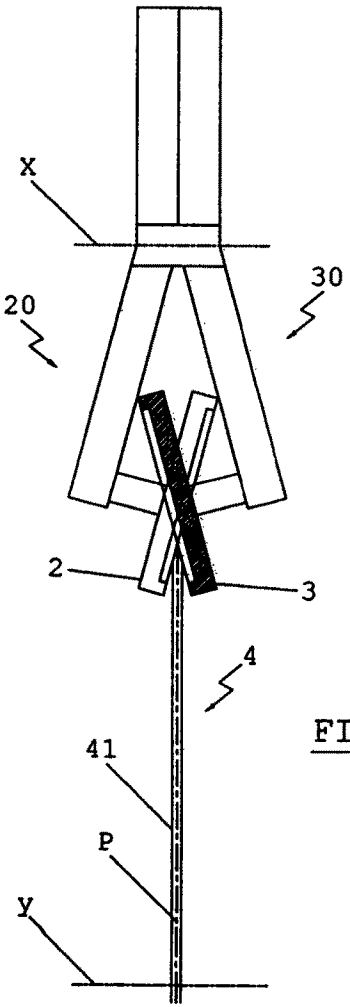
Figure 2A:
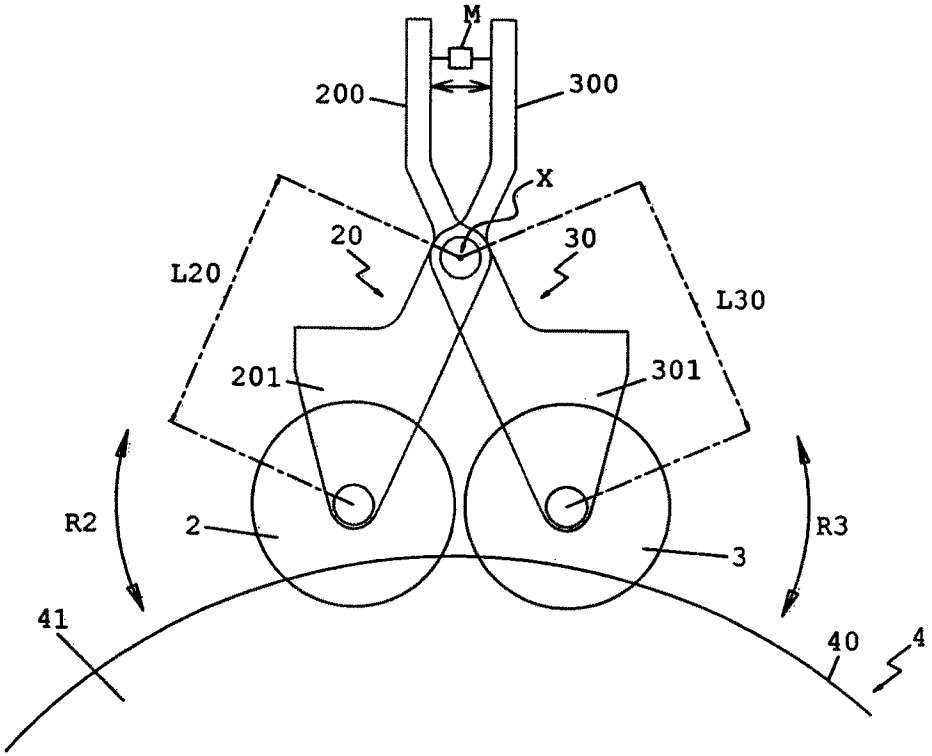

In practice, the device can have at least two configurations: a standby or rest configuration, shown in FIGS. 1A and 1B, and an active configuration, shown in FIGS. 2*a* and 2B. In the standby or rest configuration, the motor means (M) are not activated and maintain the proximal portions (200, 300) of the arms (20, 30) spaced from each other. Once activated, the motor means (M) move the proximal portions (200, 300) of the arms (20, 30) towards each other, determining the corresponding approaching of the distal portions (201, 301) that support the grinding wheels (2, 3).

Consequently, each of the grinding wheels (2, 3) follows a trajectory having the shape of circular arc (indicated with R2 and R3 in FIG. 1B) which carries the same grinding wheels in contact with the blade (4) to perform sharpening. This trajectory allows a continuous and gradual approach of the grinding wheels to the respective sides of the blade (4). In other words, the contact of each grinding wheel (2, 3) with the respective side of the cutting edge of the blade (4) is progressive, whereby the contact area between the grinding wheels and the blade increases progressively when the device passes from the rest configuration to the active configuration. Hence, a better blade sharpening is achieved and the structural integrity of the blade is preserved.

According to the example shown in the drawings, the axis of said circular arcs (R2, R3) coincides with the aforementioned axis (x) and each arc (R2, R3) is parallel to said cutting plane (P). Therefore, when moved by the arms (20, 30), the grinding wheels (2, 3) run along respective arcuate trajectories (R2, R3) parallel to the sides (41) of the blade (4).

Said arms (20, 30) can be advantageously connected with suitable pressure sensors adapted to detect the pressure exerted by each wheel (2, 3) on the respective side of the blade (4). Furthermore, said pressure sensors can be connected to the motor means (M), by means of a corresponding control unit, to control the action of the same motor means (M) on the arms (20, 30), i.e. to control the pressure exerted by the grinding wheels (2, 3) on the blade (4). In other words, a device in accordance with the present invention can be provided with means for controlling the pressure exerted by the grinding wheels (2, 3) on the blade (4).

Advantageously, the device (1) can be connected with a control device adapted for controlling the sharpening of the blade (4) that, in turn, can be connected with said motor means (M). In this way it is possible to obtain an automatic sharpening of the blade (4) when the control device detects a not correct sharpening.

Furthermore, preferably, said grinding wheels and the related arms are identical and placed in symmetrical positions with respect to the cutting plane of the blade, so as to determine an identical behavior of the two grinding wheels on both sides of the blade.

Figure 3:
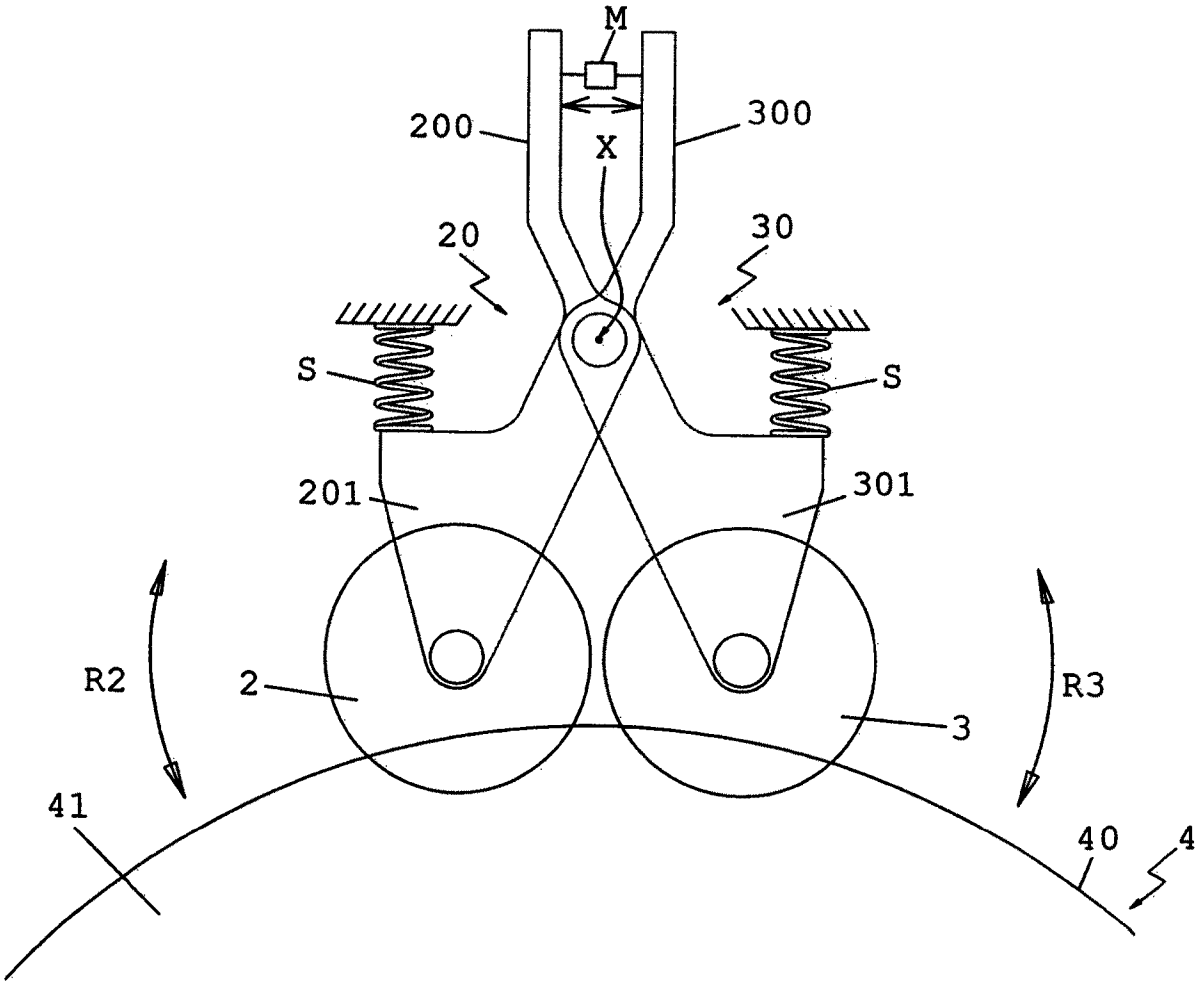
FIG. 3 represents a further embodiment of a device according to the invention in the active configuration.
Figure 4:
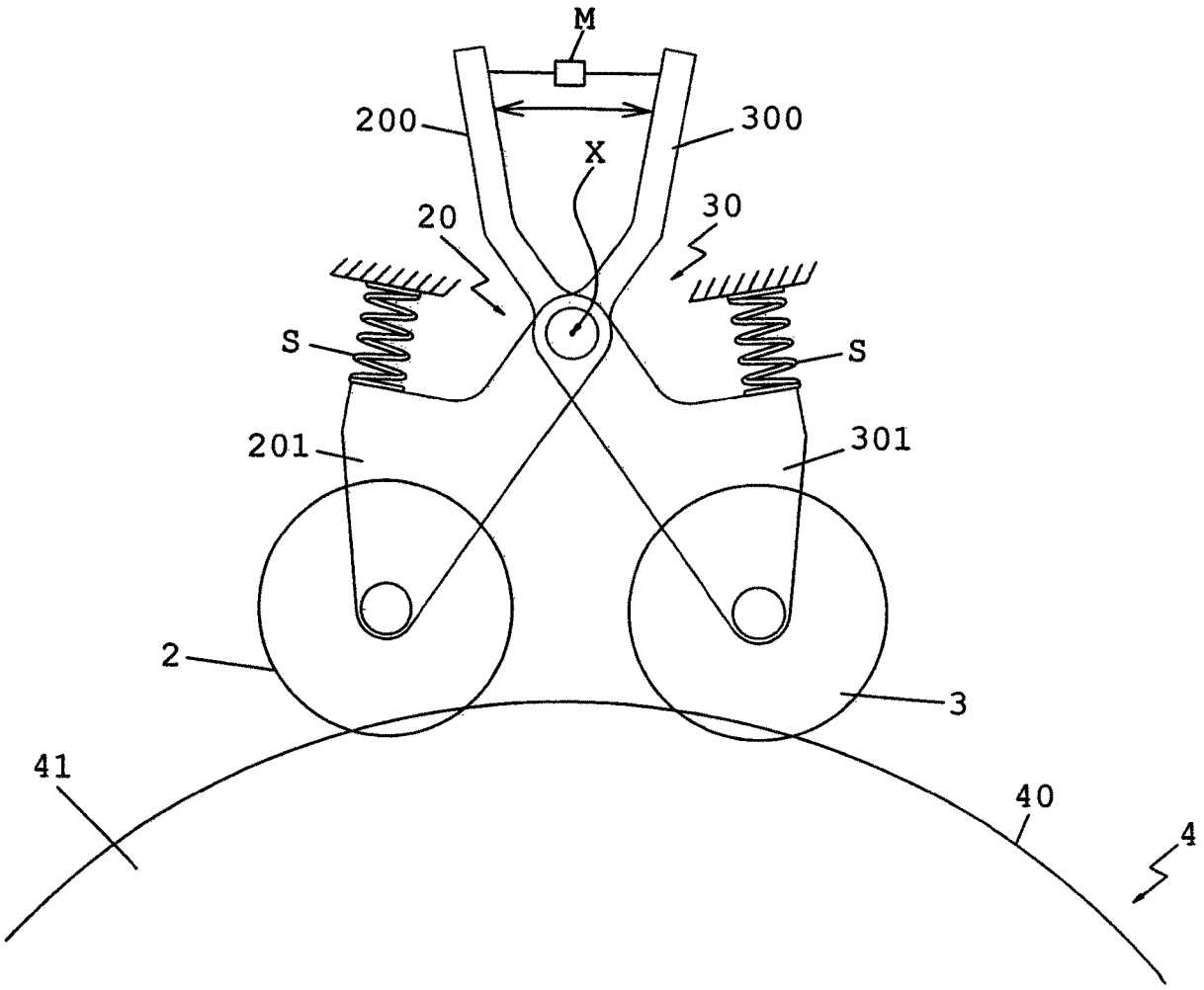
FIG. 4 represents the device of FIG. 3 in the rest configuration.

With reference to the example shown in FIG. 3 and FIG. 4, two identical springs (S) are provided, acting each on a respective arm (20,30). A single motor means is used to simultaneously operate the arms (20, 30) that support the two grinding wheels. The movement of the grinding wheels according to the examples given above is such as to bring the grinding wheels in a defined position so that there is always a fixed geometric interference between the grinding wheels and the blade, or there is always a fixed pressure exerted by the grinding wheels on the blade. In practice, the details of execution may vary in any equivalent way as in the shape, dimensions, elements disposition, nature of the materials used, without leaving the scope of the adopted solution and thus remaining within the limits of the protection granted by this patent.

The invention claimed is:

1. A sharpening device for sharpening blades mounted on cutting machines, the sharpening device comprising:

two grinding wheels supported by respective movable supports adapted to move said grinding wheels from a standby or rest configuration in which the grinding wheels are positioned at a predetermined distance from a blade having a cutting edge and two opposite sides between which the cutting edge is comprised to an active configuration in which the grinding wheels are in contact with said cutting edge and said cutting edge is in contact with the grinding wheels along a predetermined trajectory, said movable supports being configured to move said grinding wheels at least along respective arcuate trajectories parallel to the two opposite sides of the blade, such that the contact of each grinding wheel with a respective side of the cutting edge of the blade is progressive, whereby the contact between the grinding wheels and the blade at least increases progressively when the grinding wheels pass from the standby or rest configuration to the active configuration.

2. A sharpening device according to claim 1, wherein said movable supports are hinged to each other so as to define a double lever with resisting force defined by friction generated by the contact of the grinding wheels with the blade.

3. A sharpening device according to claim 2, wherein a fulcrum of said double lever has an axis at least perpendicular to a plane that is defined by the blade and said axis is external to the blade.

4. A sharpening device according to claim 3, further comprising:

an actuating means acting on said movable arms, said actuating means acting bi-directionally so as to approach or distance proximal portions of said movable arms and to respectively distance or approach corresponding distal portions of the movable arms supporting said grinding wheels.

5. A sharpening device according to claim 2, further comprising:

an actuating means acting on said movable supports, said actuating means acting bi-directionally so as to approach or distance proximal portions of said movable supports and to respectively distance or approach corresponding distal portions of the movable supports supporting said grinding wheels.

6. A sharpening device according to claim 5, wherein said means for moving the movable supports is connected to a control device that controls a state of sharpening of the blade.

7. A sharpening device according to claim 5, wherein said actuating means controls a pressure exerted by the grinding wheels on the blade.

8. A sharpening device according to claim 5, wherein said actuating means controls a position of the grinding wheels with respect to the blade.

9. A sharpening device according to claim 1, wherein a corresponding traction or compression spring is arranged on each of said movable supports.

10. A sharpening device according to claim 9, wherein each spring is identical.

11. A sharpening device according to claim 10, wherein each spring exerts a same force on said movable supports.

12. A sharpening device according to claim 9, wherein each spring exerts a same force on said movable supports.

* * * * *